United States Patent [19]

O'Hara

[11] 4,446,388

[45] May 1, 1984

[54] MICROWAVE PHASE DISCRIMINATOR

[75] Inventor: Francis J. O'Hara, Bedford, Mass.

[73] Assignee: Raytheon Company, Lexington, Mass.

[21] Appl. No.: 375,514

[22] Filed: May 6, 1982

[51] Int. Cl.[3] ..... H01P 1/18

[52] U.S. Cl. ..... 307/511; 333/157; 329/137

[58] Field of Search ..... 307/511; 333/156, 157, 333/160, 161, 258; 329/137, 161

[56] References Cited

U.S. PATENT DOCUMENTS

| | | | |
|---|---|---|---|
| 2,928,940 | 3/1960 | Ruthroff | 329/137 |
| 3,546,636 | 12/1970 | Piazza | 307/511 |
| 3,956,706 | 5/1976 | Saul | 307/511 |
| 3,996,533 | 12/1976 | Lee | 333/161 |
| 4,161,705 | 7/1979 | Nemit et al. | 333/156 |
| 4,281,293 | 7/1981 | Childs et al. | 329/137 |

*Primary Examiner*—John S. Heyman

*Attorney, Agent, or Firm*—Philip J. McFarland; Joseph D. Pannone

[57] ABSTRACT

A microwave phase discriminator is shown to include a microwave bridge network having two pairs of input ports and two pairs of output ports, the phase shift of signals passing through such network being dependent upon which one of the input ports is actuated, a diode detector connected to each one of the output ports, a difference amplifier connected to each pair of diode detectors, a single-pole double-throw switch connected to each input port and commutating switches at the inputs to the corresponding difference amplifiers.

3 Claims, 2 Drawing Figures

MICROWAVE PHASE DISCRIMINATOR

BACKGROUND OF THE INVENTION

This invention pertains generally to microwave phase discriminators, and particularly to a type of microwave phase discriminator fabricated using four identical directional couplers. It is possible to configure these couplers so that microwave signals may pass therethrough without encountering discontinuities or short circuits.

It is known in the art that a microwave phase discriminator may be used in many applications, such as in sidelobe cancellers, cross-polarization generators and instantaneous frequency and bearing monitors. A microwave phase discriminator for any such an application may be made up of a microwave bridge network, a plurality of square-law detectors and a pair of differential amplifiers to produce two signals representative of the phase difference between two input signals.

It is known that compensation for some channel-to-channel imbalances may be effected by commutating, or switching, pairs of signals between the two signal channels so that an averaging process may be applied. Thus, within a conventional microwave phase discriminator, commutation may be implemented by double-pole double-throw switches before each diode pair arranged periodically to reverse the signals applied to the diodes, and additional double-pole, double-throw switches before the inputs of each one of the differential amplifiers. Obviously, providing such switches and the requisite control circuitry complicates the design of the phase discriminator. Even when such commutation is effected, adequate compensation is difficult to achieve because of any imbalances existing in the switches.

SUMMARY OF THE INVENTION

With this background of the invention in mind, it is therefore a primary object of this invention to provide an improved microwave phase discriminator wherein commutation may be realized by use of single-pole, double-throw microwave switches to average any imbalances, including any between detector diodes and post-detection amplifiers.

It is another object of this invention to provide an improved microwave bridge network having no abrupt circuit discontinuities or short-circuits.

The foregoing and other objects of this invention are generally attained by providing, for use in a microwave phase discriminator having differential amplifiers, an improved microwave bridge network comprising four 45°/135° hybrid couplers which have no abrupt circuit discontinuities and may be easily switched by a first set of single-pole, double-throw microwave switches to interchange output signals from such network. The commutation process in the microwave phase discriminator then is completed by a set of double-pole, double-throw video switches in the input circuits of the differential amplifiers or by sign-reversal of the amplifier outputs (readily accomplished in any associated digital signal processor).

BRIEF DESCRIPTION OF THE DRAWINGS

For a more complete understanding of this invention, reference is now made to the following description of a preferred embodiment illustrated in the accompanying drawings, wherein.

DESCRIPTION OF THE PREFERRED EMBODIMENT

Before referring to the FIGURES in detail it should be noted that the microwave bridge network contemplated to be used herein is made up of 3 db directional couplers, each designed in a manner described in the article entitled "Practical Strip-Line Microwave Circuit Design" (by G. L. Millican and R. C. Wales, IEEE Transactions on Microwave Theory and Techniques, Vol. MTT-17, No. 9, Sept. 1969, pp. 696–705) to provide relative phase shifts of 135° or 45° between microwave signals at the primary and secondary arms of such network. Also, a useful coupler may be constructed from a 90° hybrid coupler plus 45° fixed phase shifter in one output line.

Figure 1:
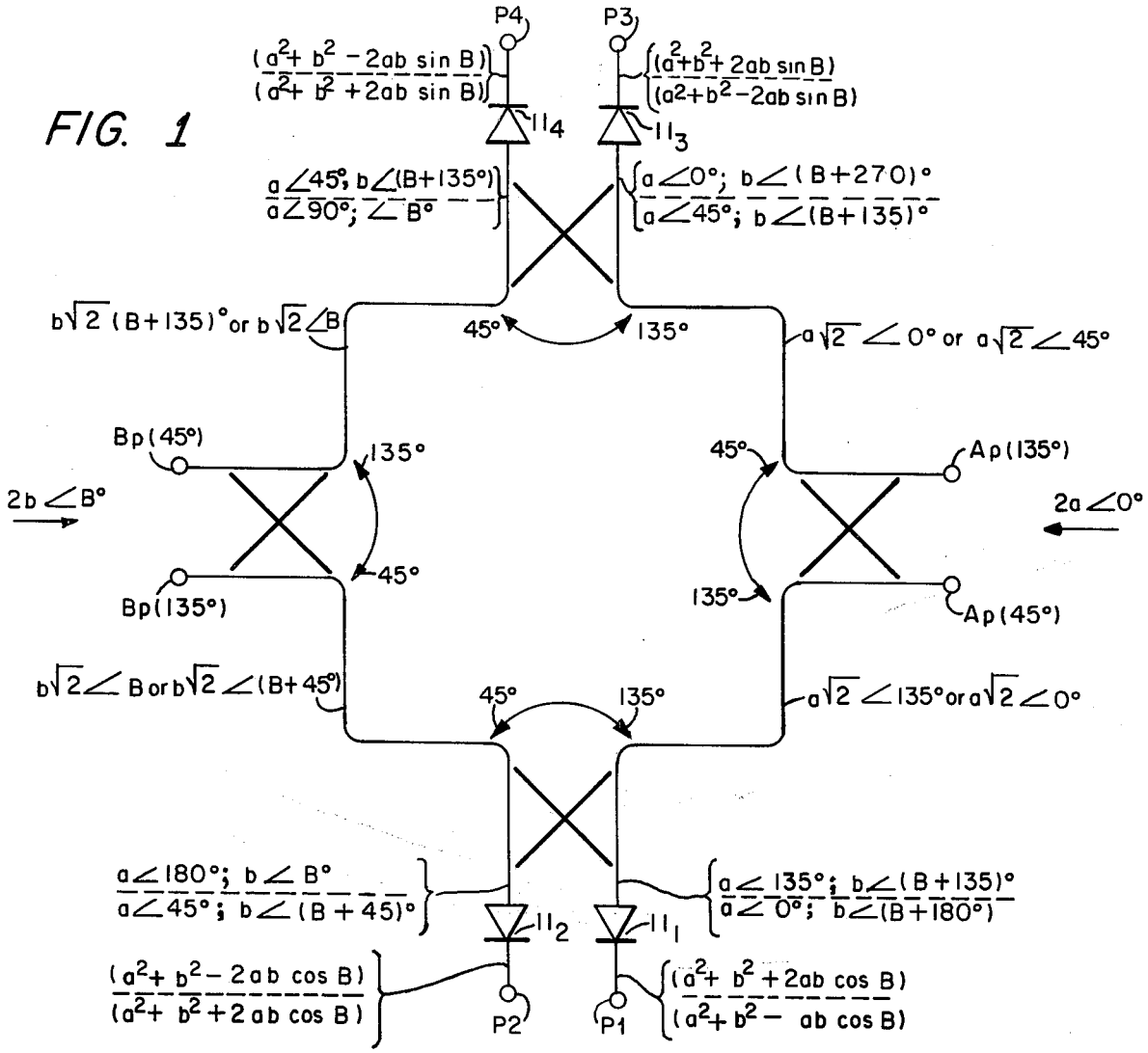
FIG. 1 is a schematic diagram of an improved microwave bridge network according to this invention.

Referring now to FIG. 1, a microwave bridge network 10 is shown to include four "3 dB" directional couplers (not numbered). Each one of such couplers is effective to produce a relative phase shift of +45° between the microwave signals at the primary and secondary arms when a microwave signal is applied to one input port (for example those marked "Ap(45°)" and "Bp(45°)" for the bridge input couplers), and a relative phase shift of +135° when the microwave signal is applied to the other input port (say those marked "Ap(135°)" and "Bp(135°)" for the bridge input couplers). Arrows (not numbered) across each one of the directional couplers indicate the phase shift experienced by a signal passing from the primary arm to the secondary arm of each such coupler. Thus, for example, a signal applied to input port Bp(135°) would appear ultimately at a diode detector $\mathbf{11}_1$ after having been shifted in phase by 135°; a signal applied to input port Bp(45°) would ultimately appear at the diode detector $\mathbf{11}_1$, after having been shifted in phase by 180°. The notation adjacent each line in FIG. 1 shows how two signals, designated "2a<0°" and "2b<B°", are shifted in phase and changed in amplitude when such signals are applied, first, respectively, to input ports Ap(135°) and Bp(135°) and then to input ports Ap(45°) and Bp(45°). At the inputs to the diodes $\mathbf{11}_1$, $\mathbf{11}_2$, $\mathbf{11}_3$, $\mathbf{11}_4$ it will be noted that: (a) the sets of signals above the broken line are the sets of signals appearing when the signals 2a<0° and 2b<B° are applied to input ports Ap(135°) and Bp(135°); and, (b) the sets of signals below the broken line are the sets of signals appearing when the signals 2a<0° and 2b<B° are applied to input ports Ap(45°) and Bp(45°). The output signals of the diodes $\mathbf{11}_1$, $\mathbf{11}_2$, $\mathbf{11}_3$, $\mathbf{11}_4$ are similarly designated. It will now be observed that when the signals are switched between input ports Ap(135°) and Ap(45°) and also between the input ports Bp(135°) and Bp(45°) the signals out of diode $\mathbf{11}_1$ and diode $\mathbf{11}_2$ are interchanged and the signals out of diode $\mathbf{11}_3$ and diode $\mathbf{11}_4$ are interchanged.

Figure 2:
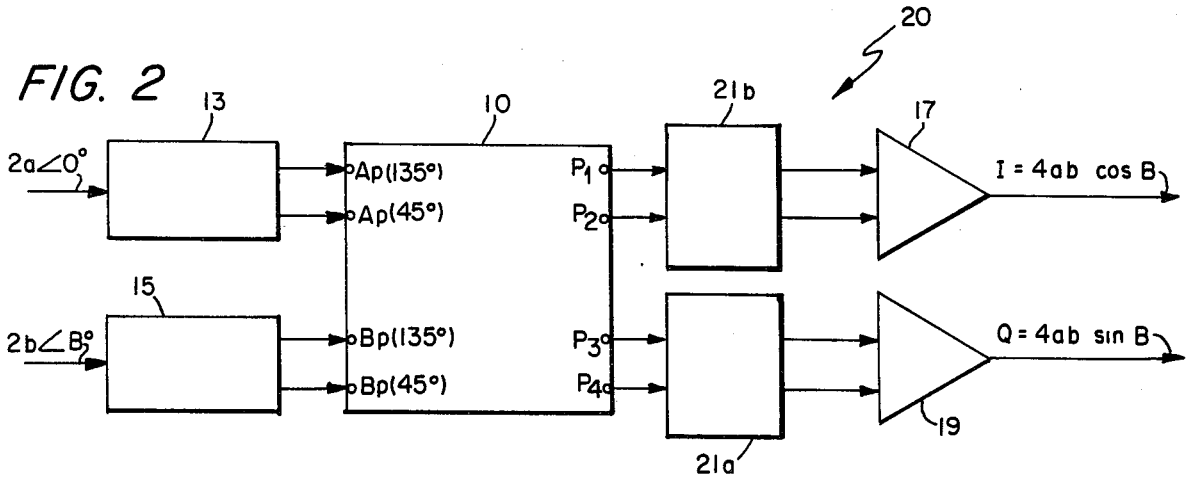
FIG. 2 is a simplified block diagram of an improved microwave phase discriminator employing the bridge network of FIG. 1.

Referring now to FIG. 2, a microwave phase discriminator according to this invention is shown to comprise the just-described microwave bridge network 10 in circuit with a pair of single-pole double-throw switches 13, 15, a pair of differential amplifiers 17, 19 and switching networks **21*a*, 21*b*. A controller 23 of any conventional design is also provided to actuate switches 13, 15 and switching networks 21*a*, 21*b*** in synchronism whenever it is desired to commutate. In normal operation of the phase discriminator the signals from the output ports P1 and P2 (FIG. 1) respectively are passed directly to the noninverting and inverting inputs of the differential amplifier 17. The latter than is effective to form an output signal which may be expressed as:

$$I=4ab\cos\theta \qquad \text{(Eq. 1)}$$

In like manner, the signals from output ports P3 and P4 (FIG. 1) are passed directly to the noninverting and inverting inputs, respectively, of the differential amplifier 19. That device combines those input signals to provide an output signal which may be expressed as:

$$Q=4ab\sin\theta \qquad \text{(Eq. 2)}$$

It should be noted here in passing that the output signals from the differential amplifiers 17, 19 are designated as "I" (in-phase) and "Q" (quadrature phase) output signals, respectively. These two output signals are, in fact, the I and Q components of the correlation of the two R.F. input signals over a time period corresponding to the video bandwidth of the microwave phase discriminator 20.

As mentioned briefly hereinabove, the switching networks 21*a*, 21*b* at the input of each of the differential amplifiers 17, 19, are provided for the purpose of commutation. Each such switching network comprises a pair of double-pole, double-throw switches (not shown) that are effective to switch the inputs to the differential amplifiers 17, 19 in order to maintain the sign of the outputs of the phase discriminator 20. When commutation is desired, the double-pole, double-throw switches (not shown) are switched in synchronism with the single-pole, double-throw switches 13, 15. Activating the latter causes the "plus" and "minus" sign of the outputs from differential amplifiers 17, 19, to be interchanged. Any scheme which effectively switches the polarity of the outputs from the differential amplifiers may be used in lieu of switches 21*a* and 21*b* to fulfill the commutation process. Thus, the switching networks 21*a*, 21*b*, when switched in synchronism with the single-pole, double-throw switches 13, 15, average any error (including any imbalance between detector diodes) by commutating the output signals.

Having described a preferred embodiment of this invention, it will now be apparent to one of skill in the art that many changes may be made without departing from the inventive concept of forming a phase discriminator from a bridge network having four 45°/135° hybrid couplers. It is felt, therefore, that this invention should not be restricted to its disclosed embodiments, but rather should be limited only by the spirit and scope of the appended claims.

What is claimed is:

1. A microwave phase discriminator wherein microwave signals may be commutated to average errors, such discriminator comprising:

(a) a microwave bridge network having two pairs of input ports and two pairs of output ports, the phase shift of microwave signals passing from each one of the input ports in each pair thereof to each one of the output ports being different;

(b) a first set of two single-pole, double-throw switches connected, respectively, to each pair of input ports to apply microwave signals to selected ones of such input ports;

(c) two pairs of diode detectors connected, respectively, to each one of the output ports, the detected signal out of each such detector being related by a square-law relationship to the phase-shifted microwave signals combined at the corresponding output terminal;

(d) a second set of two double-pole, double-throw switches connected to the outputs of the diode detectors; and (e) a differential amplifier connected to each one of the two double-pole double-throw switches to produce signals indicative of the instantaneous phase difference between the microwave signals applied to the input ports of the microwave bridge network.

2. The microwave phase discriminator as in claim 1 wherein the microwave bridge network comprises:

(a) a first pair of 3 dB directional couplers, each one of such couplers having a first, second, third and fourth port, the phase shift of microwave signals passing through each such coupler to appear at the third and fourth port being dependent upon whether a microwave signal is applied to the first or the second port;

(b) a second pair of 3 dB directional couplers corresponding in construction to the directional couplers in the first pair thereof, the first and second ports of one of the second pair of directional couplers being connected, respectively, to the third and fourth ports of different ones of the first pair of directional couplers and the fourth and third ports of the other one of the second pair of directional couplers being connected, respectively, to the second and first ports of different ones of the first pair of directional couplers.

3. The microwave phase discriminator as in claim 2 wherein the phase shift experienced by a microwave signal passing from the first to the third port relative to a signal from the first to the fourth port of each one of the 3 dB directional couplers is 135° and the phase shift experienced by a microwave signal passing from the second to the fourth port relative to a signal from the second to the third port of each one of the 3 dB directional couplers is 45°.

* * * * *